US009890023B2

(12) United States Patent
Codd et al.

(10) Patent No.: US 9,890,023 B2
(45) Date of Patent: Feb. 13, 2018

(54) SLACK LINE DETECTION SYSTEMS FOR WINCHES

(71) Applicant: Ingersoll-Rand Company, Davidson, NC (US)

(72) Inventors: Paul M. Codd, Seattle, WA (US); Anthony A. Jones, Maple Valley, WA (US)

(73) Assignee: Ingersoll-Rand Company, Davidson, NC (US)

( * ) Notice: Subject to any disclaimer, the term of this patent is extended or adjusted under 35 U.S.C. 154(b) by 161 days.

(21) Appl. No.: 14/282,416

(22) Filed: May 20, 2014

(65) Prior Publication Data

US 2015/0336779 A1 Nov. 26, 2015

(51) Int. Cl.
*B66D 5/02* (2006.01)
*B66D 1/56* (2006.01)
(Continued)

(52) U.S. Cl.
CPC ..... *B66D 5/02* (2013.01); *B66D 1/08* (2013.01); *B66D 1/50* (2013.01); *B66D 1/56* (2013.01)

(58) Field of Classification Search
CPC ... B66D 1/36; B66D 1/38; B66D 1/42; B66D 1/46; B66D 1/48; B66D 1/50;
(Continued)

(56) References Cited

U.S. PATENT DOCUMENTS 1,848,972 A * 3/1932 Peebles ..... A01B 3/64 200/61.18
2,419,808 A * 4/1947 Wirth ..... B65H 59/04 242/156.2
(Continued)

FOREIGN PATENT DOCUMENTS

CN 202967978 6/2013
CN 103189298 7/2013
(Continued)

OTHER PUBLICATIONS

European Patent Office, Communication regarding EP15167267.2, dated Oct. 28, 2015, 8 pages.
(Continued)

*Primary Examiner* — Sang K Kim
*Assistant Examiner* — Nathaniel L Adams
(74) *Attorney, Agent, or Firm* — Barnes & Thornburg LLP

(57) ABSTRACT

In at least one illustrative embodiment, a winch may include first and second end frames, a drum coupled between the first and second end frames and configured to rotate to wind or unwind a cable, a brake configured to resist rotation of the drum when engaged, a switch configured to cause the brake to engage the drum when the switch is activated, a slack arm frame having a first end engaged with the cable and a second end pivotally coupled between the first and second end frames, where the slack arm frame is configured to pivot between a first position when the cable is taut and a second
(Continued)

position when the cable is slack, and a cam coupled to the slack arm frame and configured to rotate with the slack arm frame to activate the switch when the slack arm frame is in the second position.

9 Claims, 4 Drawing Sheets

(51) Int. Cl.
*B66D 1/08* (2006.01)
*B66D 1/50* (2006.01)

(58) Field of Classification Search
CPC ..... B66D 1/505; B66D 1/52; B66D 1/525; B66D 3/24; B66D 3/26; B66D 5/02; B66D 5/10; B66D 5/14; B66D 5/18; B66D 5/20; B66D 5/22; B66D 1/56; B65H 63/02; B65H 75/4402; B65H 75/4418; B65H 75/4421; B65H 59/04
See application file for complete search history.

(56) References Cited

U.S. PATENT DOCUMENTS

| | | | | | |
|---|---|---|---|---|---|
| 2,462,972 | A | * | 3/1949 | Johnson | B66D 1/50 188/105 |
| 2,636,953 | A | | 4/1953 | Hunt | |
| 3,042,375 | A | | 7/1962 | Fahey et al. | |
| 3,069,107 | A | * | 12/1962 | Hirt | B21C 47/18 242/156 |
| 3,960,362 | A | * | 6/1976 | Griffiths | B66D 3/24 254/276 |
| 4,190,980 | A | | 3/1980 | Grycel | |
| 4,305,513 | A | | 12/1981 | Voelz | |
| 4,390,161 | A | | 6/1983 | Nelson | |
| 4,449,806 | A | | 5/1984 | Wong et al. | |
| 4,624,450 | A | | 11/1986 | Christison | |
| 4,906,051 | A | | 3/1990 | Vilhauer | |
| 5,226,249 | A | * | 7/1993 | Pippins | E02F 3/58 200/332 |
| 5,960,849 | A | | 10/1999 | Delaney et al. | |
| 6,782,662 | B2 | | 8/2004 | McCartney et al. | |
| 6,966,544 | B2 | | 11/2005 | McCormick et al. | |
| 7,185,881 | B2 | | 3/2007 | Drarvik et al. | |
| 7,201,366 | B2 | | 4/2007 | Sanders et al. | |
| 7,222,839 | B2 | | 5/2007 | Taylor et al. | |
| 7,374,153 | B2 | | 5/2008 | Huang | |
| 7,658,370 | B2 | | 2/2010 | Rotzler et al. | |
| 7,748,685 | B2 | | 7/2010 | Richards | |
| 2010/0308148 | A1 | | 12/2010 | Ng | |
| 2011/0001102 | A1 | * | 1/2011 | Hossler | B66D 5/10 254/322 |
| 2011/0193037 | A1 | | 8/2011 | Smith | |
| 2012/0138881 | A1 | | 6/2012 | Elliott et al. | |
| 2015/0041740 | A1 | | 2/2015 | Codd | |

FOREIGN PATENT DOCUMENTS

| | | | |
|---|---|---|---|
| CN | 203048477 | | 7/2013 |
| DE | 2336042 | A1 | 1/1975 |
| EP | 1371600 | A2 | 12/2003 |
| WO | 20150020851 | A1 | 2/2015 |

OTHER PUBLICATIONS

Ingersoll-Rand, "Product Instructions: Air Powered Man Rider Winch," Apr. 2013, 12 pages.
Ingersoll-Rand Company, "Product Parts Information: Air Powered Man Rider Winch," Sep. 2009, 24 pages.
Ingersoll-Rand Company, "Liftstar Pneumatic ManRider Winch," 2006, 2 pages.
Ingersoll-Rand Company, "Product Information: Model FA150KGi," Jan. 2011, 16 pages.
Ingersoll-Rand Company, "Product Parts Information: Model FA150KGi," Jan. 2011, 24 pages.
First Office Action; Chinese Application No. 201510253282.0; dated Apr. 1, 2017.
Second Office Action—CN 201510253282.0.
English Translation of Second Office Action CN 201510253282.0.

* cited by examiner

SLACK LINE DETECTION SYSTEMS FOR WINCHES

TECHNICAL FIELD

The present disclosure relates, generally, to winches and, more particularly, to slack line detection systems for winches.

BACKGROUND

Winches (sometimes also referred to as "hoists") are commonly used in lifting and lowering loads, for example, materials, workpieces, and/or persons, via a cable or chain that wraps and unwraps around a drum. Such winches are often used to move materials, workpieces, and/or persons about a factory or industrial site, for example an offshore oil rig. A slack line condition may occur when the cable goes slack, for example, when the load lands on the ground or is otherwise obstructed while the cable is being paid out. Winches may include one or more slack line condition sensors that automatically brake the winch drum when such a slack line condition is detected.

SUMMARY

According to one aspect, a winch may include a first end frame and a second end frame, a drum coupled between the first and second end frames and configured to rotate to wind or unwind a cable, a brake configured to resist rotation of the drum when engaged, a switch configured to cause the brake to engage the drum when the switch is activated, a slack arm frame having a first end engaged with the cable and a second end pivotally coupled between the first and second end frames, wherein the slack arm frame is configured to pivot between a first position when the cable is taut and a second position when the cable is slack, a cam coupled to the slack arm frame and configured to rotate with the slack arm frame to activate the switch when the slack arm frame is in the second position, and a mounting bracket coupling the switch to the first end frame, wherein the mounting bracket is adjustable between a plurality of locations on the first end frame by loosening and tightening a single fastener, each of the plurality of locations positioning the switch at a different distance from the cam.

In some embodiments, the winch may further include a motor configured to drive rotation of the drum in response to being supplied with a flow of compressed fluid, wherein the brake may include a biasing member configured to (i) disengage the brake when the motor is being supplied with the flow of compressed fluid and (ii) engage the brake when the motor is not being supplied with the flow of compressed fluid, and wherein the switch is configured to interrupt the flow of compressed fluid to the motor when the switch is activated.

In some embodiments, the first end frame may include an elongated slot, and the mounting bracket may include a dowel pin received in the elongated slot, the dowel pin and the single fastener cooperating to secure the mounting bracket to the first end frame. The slack arm frame may be adjustable relative to the cam between (i) a vertical takeoff orientation in which the slack arm frame, when in the first position, extends away from the drum at an angle between 80 and 100 degrees to a surface supporting the winch and (ii) a horizontal takeoff orientation in which the slack arm frame, when in the first position, extends away from the drum at an angle between −10 and 10 degrees to the surface supporting the winch.

In some embodiments, the slack arm frame may include a first lever arm pivotally coupled to the first end frame and extending away from the drum toward the first end of the slack arm frame, a second lever arm pivotally coupled to the second end frame and extending away from the drum toward the first end of the slack arm frame, a roller assembly coupled between the first and second lever arms at the first end of the slack arm frame, wherein the cable passes through the roller assembly, and a first drop stop coupled to the first lever arm and extending toward the first end frame, the first drop stop being configured to engage the first end frame when the slack arm frame pivots from the first position to the second position to prevent further pivoting of the slack arm frame. The slack arm frame may further include a second drop stop coupled to the second lever arm and extending toward the second end frame, the second drop stop being configured to engage the second end frame when the slack arm frame pivots from the first position to the second position to prevent further pivoting of the slack arm frame. The first drop stop may include a screw coupled to a nut, the screw being configured to engage the first end frame when the slack arm frame pivots from the first position to the second position.

In some embodiments, the slack arm frame may be adjustable between a forward orientation in which the first and second lever arms pivot toward a front side of the winch when the slack arm frame pivots from the first position to the second position, and a reverse orientation in which the first and second lever arms pivot toward a back side of the winch when the slack arm frame pivots from the first position to the second position, the back side of the winch being opposite the front side of the winch. The first lever arm may include a tool hole sized to receive a tool to prevent pivoting of the slack arm frame.

According to another aspect, a winch may include a first end frame and a second end frame, a drum coupled between the first and second end frames and configured to rotate to wind or unwind a cable, a brake configured to resist rotation of the drum when engaged, a switch configured to cause the brake to engage the drum when the switch is activated, a slack arm frame engaging the cable and including a first lever arm and a second lever arm, the first lever arm pivotally coupled to the first end frame and the second lever arm pivotally coupled to the second end frame, wherein the slack arm frame is configured to pivot between a first position when the cable is taut and a second position when the cable is slack, a cam coupled to the slack arm frame and configured to rotate with the slack arm frame to activate the switch when the slack arm frame is in the second position, and a first drop stop coupled to the first lever arm and extending toward the first end frame, the first drop stop being configured to engage the first end frame when the slack arm frame pivots from the first position to the second position to prevent further pivoting of the slack arm frame. The winch may further include a second drop stop coupled to the second lever arm and extending toward the second end frame, the second drop stop being configured to engage the second end frame when the slack arm frame pivots from the first position to the second position to prevent further pivoting of the slack arm frame.

In some embodiments the first drop stop may include a first screw coupled to a first nut, the first screw being configured to engage the first end frame when the slack arm frame pivots from the first position to the second position, and the second drop stop may include a second screw coupled to a second nut, the second screw being configured to engage the second end frame when the slack arm frame pivots from the first position to the second position. The drop stop may be adjustable between a first drop stop position on the first lever arm and a second drop stop position on the first lever arm, the first drop stop position being closer to the first end frame than the second drop stop position when the slack arm frame is in the first position.

In some embodiments, the slack arm frame is adjustable between: a vertical takeoff orientation in which (i) the slack arm frame, when in the first position, extends away from the drum at an angle between 80 and 100 degrees to a surface supporting the winch and (ii) the first drop stop is coupled to the first lever arm at the first drop stop position, and a horizontal takeoff orientation in which (i) the slack arm frame, when in the first position, extends away from the drum at an angle between −10 and 10 degrees to the surface supporting the winch and (ii) the first drop stop is coupled to the first lever arm at the second drop stop position.

In some embodiments, the winch may further include a mounting bracket coupling the switch to the first end frame, wherein the mounting bracket is adjustable between a plurality of locations on the first end frame by loosening and tightening a single fastener, each of the plurality of locations positioning the switch at a different distance from the cam.

According to another aspect, a winch may include a first end frame and a second end frame, a drum coupled between the first and second end frames and configured to rotate to wind or unwind a cable, a brake configured to resist rotation of the drum when engaged, a switch configured to cause the brake to engage the drum when the switch is activated, a first lever arm pivotally coupled to the first end frame, a second lever arm pivotally coupled to the second end frame, a roller assembly coupled between the first and second lever arms, wherein the cable passes through the roller assembly, a cam coupled to the first lever arm and configured to rotate with the first lever arm to activate the switch when the first and second lever arms pivot in response to the cable becoming slack, wherein the first lever arm and the second lever arm are adjustable between (i) a forward orientation in which the first and second lever arms are configured to pivot toward a front side of the winch when the cable becomes slack and (ii) a reverse orientation in which the first and second lever arms are configured to pivot toward a back side of the winch when the cable becomes slack, the back side of the winch being opposite the front side of the winch.

In some embodiments, the first lever arm may be adjustable relative to the cam between (i) a vertical takeoff orientation in which the first lever arm, when the cable is taut, extends away from the drum at an angle between 80 and 100 degrees to a surface supporting the winch and (ii) a horizontal takeoff orientation in which the first lever arm, when the cable is taut, extends away from the drum at an angle between −10 and 10 degrees to the surface supporting the winch.

In some embodiments, the winch may further include a first drop stop coupled to the first lever arm and extending toward the first end frame, the first drop stop being configured to engage the first end frame when the slack arm frame pivots in response to the cable becoming slack to prevent further pivoting of the slack arm frame. The winch may further include a second drop stop coupled to the second lever arm and extending toward the second end frame, the second drop stop being configured to engage the second end frame when the slack arm frame pivots in response to the cable becoming slack to prevent further pivoting of the slack arm frame.

In some embodiments, the winch may further include a mounting bracket coupling the switch to the first end frame, wherein the mounting bracket is adjustable between a plurality of locations on the first end frame by loosening and tightening a single fastener, each of the plurality of locations positioning the switch at a different distance from the cam.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
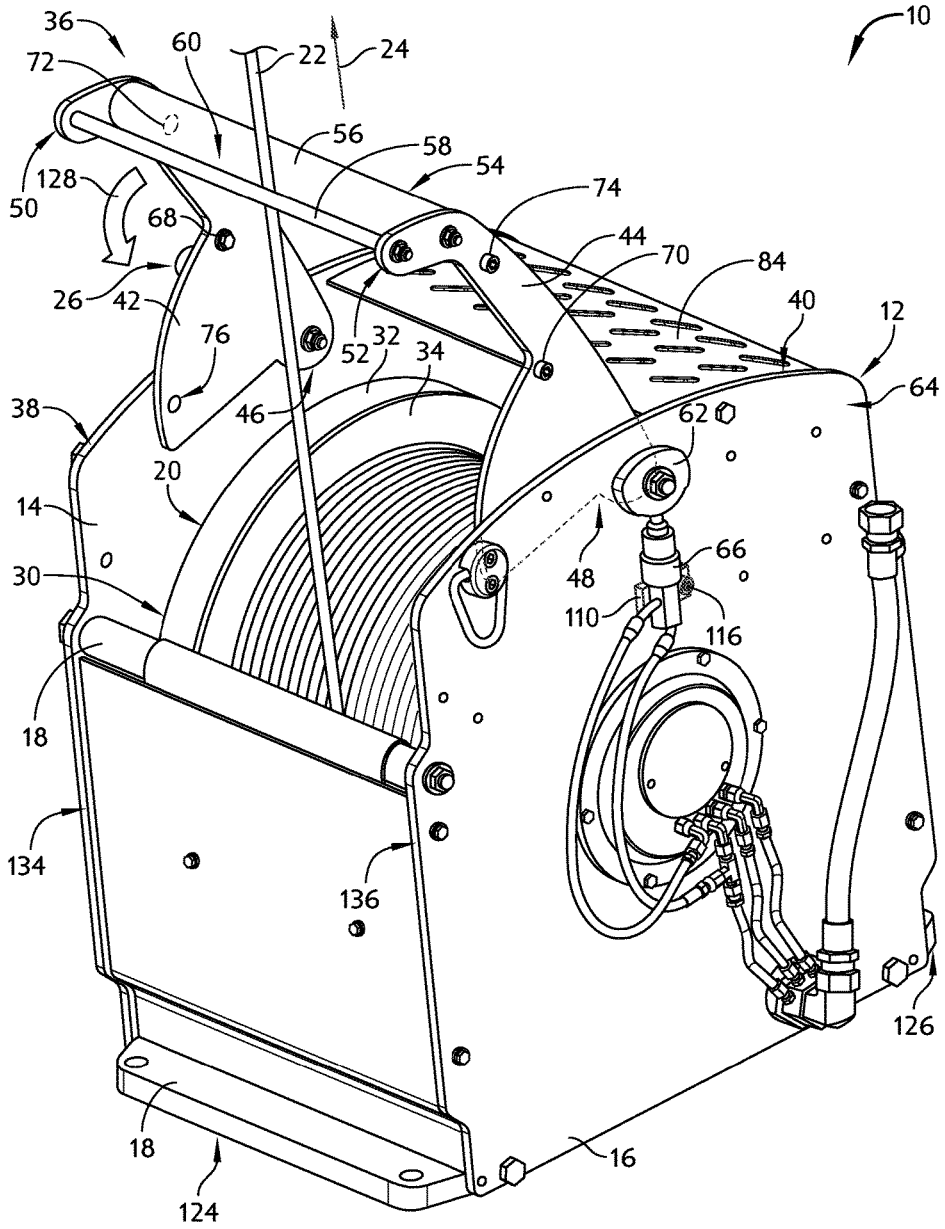
FIG. 1 is a front perspective view of one illustrative embodiment of a pneumatically operated winch including a slack line detection system installed in a forward orientation.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIG. 1, one illustrative embodiment of a winch 10 for supporting, lifting, and/or lowering a load (e.g., materials, workpieces, and/or persons) is depicted. Although the winch 10 is illustratively shown and described herein as a pneumatically operated winch, it will be appreciated that any of the concepts of the present disclosure may also be applied to any other type of winch (e.g., a hydraulically powered winch, an electrically powered winch, etc.). Furthermore, although specific directional terminology, such as front, rear, side, vertical, horizontal, clockwise, counterclockwise, etc., may be used throughout the present disclosure, it should be understood that such terms are not limiting and are only utilized herein to convey the relative position and/or orientation of different elements with respect to one another.

The winch 10 includes a frame 12 having opposing end frames 14, 16 and having supports 18 extending between and connecting the end frames 14, 16. The frame 12 may be secured to a flat surface, for example, a factory floor, an oil rig deck, or another surface. A winch drum 20 extends between the opposing end frames 14, 16 and a cable 22 is attached to and wound around the drum 20. The cable 22 may be a cable, line, chain, rope, cord, or any suitable length of material that is capable of winding and unwinding around the drum 20 (and the term "cable," as used in present disclosure, is inclusive of all such materials). In illustrative embodiment, the drum 20 may be configured to rotate, for example, in a counterclockwise direction (from the perspective of an air motor system 26 of the winch 10) to wind the cable 22 and in a clockwise direction to unwind the cable 22. As seen in FIG. 1, the winch 10 defines a payout direction for the cable 22 indicated by arrow 24. In the configuration illustrated in FIG. 1, the payout direction 24 is generally vertical (relative to the surface supporting the winch 10). In other configurations, the payout direction 24 may be generally horizontal (relative to the surface supporting the winch 10), as further described below in connection with FIG. 4.

As shown in FIG. 1, an air motor system 26 is operatively connected to the drum 20. The air motor system 26 may generally include (or be connected to) a source of compressed air, a filter regulator and a lubricator for the source of compressed air, an air motor, and/or other components necessary for the operation of the source of compressed air and the drum 20. The filter regulator, lubricator, and other conventional components of the air motor system 26 have been omitted from the drawings so as not to obscure the present disclosure. The air motor system 26 is operatively connected to the drum 20 to rotate the drum 20, thereby winding and/or unwinding the cable 22. The air motor system 26 is coupled to the drum 20 through an internal reduction gear system (not shown) that increases the mechanical advantage of the air motor system 26 and may illustratively be embodied as a planetary gear system. The air motor system 26 may be connected to a directional control lever to allow an operator to control the direction of operation of the winch 10 (i.e., payout or haul-in).

A disc brake (not shown) is coupled between the air motor system 26 and the drum 20 and/or the reduction gear system. The disc brake includes a number of friction plates that, when forced against a number of separator plates, cause the disc brake to resist rotation of the drum 20. In the illustrative embodiment, the disc brake is spring set and pneumatically released, meaning the disc brake ordinarily prevents rotation of the drum 20. When the winch 10 is operated (in either the payout direction 24 or an opposite haul-in direction), compressed air is supplied to the disc brake to oppose the spring force and release the disc brake. When the winch 10 is in neutral, however, the compressed air is vented and the spring causes the disc brake to engage. In alternative embodiments, the disc brake may include a sprag clutch to allow rotation of the drum 20 in the haul-in direction even while the disc brake is applied.

The winch 10 includes also includes a band brake 30. The band brake 30 includes a band 32 surrounding a flange 34 of the drum 20. Braking force applied to the band brake 30 tightens the band 32 on the flange 34, which resists rotational motion of the drum 20 in both directions. In the illustrative embodiment, the band brake 30 is spring set and pneumatically released, similar to the disc brake described above. Compressed air is supplied to the band brake 30 to oppose the spring force and release the band brake 30 when the winch 10 is operated (in either the payout direction 24 or the haul-in direction). When the winch 10 is in neutral, however, the compressed air is vented and the band brake 30 engages. In alternative embodiments, the band brake 30 may be manually operated (rather than being operated by the slack line detection system of the winch 10).

A slack arm frame 36 is positioned between the top edges 38, 40 of the end frames 14, 16, respectively. The slack arm frame 36 includes a pair of lever arms 42, 44 that are pivotally coupled to the end frames 14, 16, respectively. Each of the lever arms 42, 44 extends from a rear end 46, 48 including a pivot point to a front end 50, 52. A roller assembly 54 is positioned between the front ends 50, 52 of the lever arms 42, 44. The roller assembly 54 includes a roller 56 and a bar 58 extending between the lever arms 42, 44. A gap 60 is defined between the roller 56 and the bar 58, and the cable 22 passes through the gap 60. Although illustrated as including the roller 56 and the bar 58, in other embodiments the roller assembly 54 may include any number of rollers or a pair of bars with no rollers.

A cam 62 positioned on an outside surface 64 of the end frame 16 is attached to the lever arm 44. As shown in FIG. 1, the cam 62 is illustratively embodied as a lobed cam 62 having a varying radius about its circumference. In particular, in the illustrative embodiment, the cam 62 includes one section of smaller radius with sections of larger radius to each side. A switch 66 is also attached to outside surface 64 of the end frame 16, and is positioned to interface with the cam 62. As the cam 62 rotates, the cam 62 engages (or disengages) the switch 66 due to the change in radius of the cam 62. The potential for damage to the switch 66 during a slack line condition may be reduced by maintaining contact between the cam 62 and the switch 66. The switch 66 may control (e.g., interrupt) the compressed air supply to the air motor system 26, the disc brake, and/or the band brake 30, as described below. The illustrative switch 66 is a pneumatic switch; however, in other embodiments any switching technology capable of controlling the air motor system 26, the disc brake, the band brake 30, or other components of the winch 10 may be used. The angle of the cam 62 and the distance between the switch 66 and the cam 62 are both adjustable for use with vertical and/or horizontal payout directions 24. Adjustments of the cam 62 and the switch 66 are further described below with respect to FIGS. 2 and 3.

The lever arms 42, 44 each have attached a pair of drop stops 68-74. As described further below, the drop stops 68-74 may prevent excessive rotation of the slack arm frame 36 and thereby avoid pinch hazards. Drop stops 68, 72 are attached to the lever arm 42, with the drop stop 72 positioned closer to the front end 50 than the drop stop 68. Similarly, drop stops 70, 74 are attached to the lever arm 44, with the drop stop 74 positioned closer to the front end 52 than the drop stop 70. Each of the drop stops 68-74 extends away from the respective lever arm 42, 44 toward the respective end frame 14, 16. Although both lever arms 42, 44 are illustrated as including attached drop stops 68-74, in some embodiments the drop stops may be attached to only one of the lever arms 42, 44.

The lever arms 42, 44 further include tool holes 76, 78 formed therein. An operator may insert a tool, for example a screwdriver shaft, through one of the tool holes 76, 78 and rotate the slack arm frame 36 such that the tool rests against one of the top edges 38, 40 of the end frames 14, 16. It will be appreciated that the tool passing through one of the tool holes 76, 78 will prevent downward rotation of the slack arm frame 36. When the slack arm frame 36 is so locked in place, the operator may safely perform maintenance on the winch 10, among other activities. The lever arms 42, 44 may include additional or different tool holes to allow the slack arm frame 36 to be locked in other orientations, for example in a horizontal takeoff orientation. Additionally, in other embodiments (not shown), one or more tool holes might be included in only one of the lever arms 42, 44.

The winch 10 further includes a guard 84 positioned between the end frames 14, 16 and above the drum 20. The guard 84 protects the winch operator and other persons from contact with the moving drum 20, and also may prevent damage to the cable 22. As described below, the guard 84 is attached to the end frames 14, 16 using removable fasteners, and may be removed or repositioned. In the configuration of FIG. 1, the guard 84 is positioned closer to a back side 126 of the winch than to a front side 124 of the winch.

Figure 2:
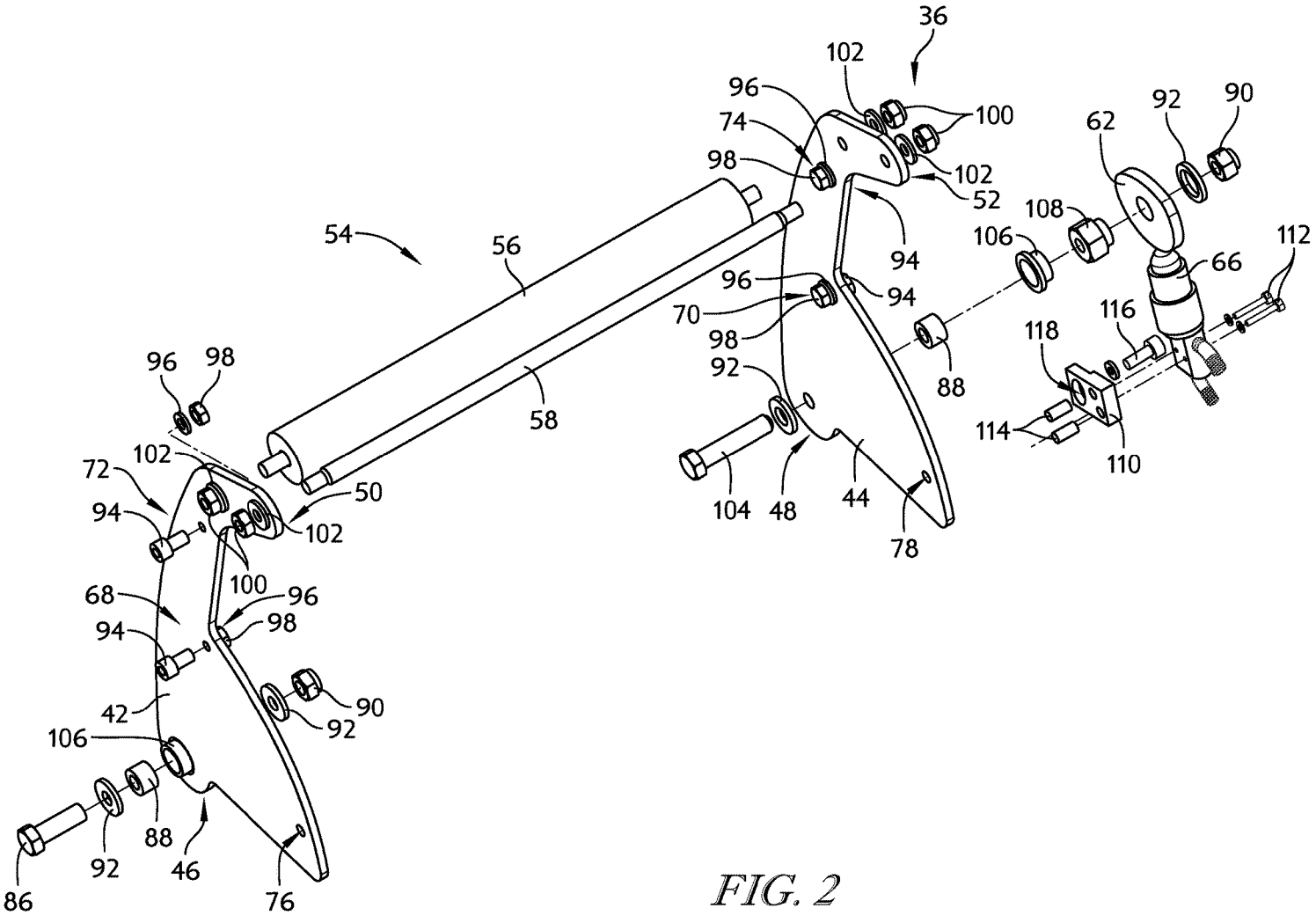
FIG. 2 is an exploded view of the slack line detection system of the winch of FIG. 1.

Referring now to FIG. 2, various components of the slack line detection system of the winch 10 are depicted in an exploded view. In the illustrative embodiment, the rear end 46 of the lever arm 42 is configured to be pivotally attached to the end frame 14 using a screw 86, a spacer 88, a bearing flange 106, a nut 90, and a pair of washers 92. As described above, the drop stops 68, 72 are attached to the lever arm 42. The drop stops 68, 72 are positioned on the lever arm 42 such that the drop stop 68 is closer to the rear end 46. In the illustrative embodiment, each of the drop stops 68, 72 includes a screw 94, a washer 96, and a nut 98, and the screw head of each of the screws 94 extends away from the lever arm 42, toward the end frame 14.

In the illustrative embodiment, the front end 50 of the lever arm 42 is attached to the roller 56 and the bar 58 using a pair of nuts 100 and a pair of washers 102. Accordingly, the roller 56 and the bar 58 include threaded ends suitable for threading the nuts 100. The roller 56 and the bar 58 are further attached to the front end 52 of the lever arm 44 using another pair of nuts 100 and washers 102.

As described above, the drop stops 70, 74 are attached to the lever arm 44. The drop stops 70, 74 are positioned on the lever arm 44 such that the drop stop 70 is closer to the rear end 48. In the illustrative embodiment, each of the drop stops 70, 74 includes a screw 94, a washer 96, and a nut 98, and the screw head of each of the screws 94 extends away from the lever arm 44, toward the end frame 16.

In the illustrative embodiment, the rear end 48 of the lever arm 44 is configured to be pivotally attached to the end frame 16 using a screw 104, a washer 92, a spacer 88, a bearing flange 106, and a hex connector 108. The cam 62 is mounted on the hex connector 108, and secured to the screw 104 with a washer 92 and a nut 90. To adjust the rotational position of the cam 62 relative to the lever arm 44, the nut 90 may be loosened, after which the angle of the cam 62 relative to the lever arm 44 may be adjusted. After such adjustment is complete, the nut 90 may be re-tightened.

The switch 66 may be attached to a mounting bracket 110 using a number of fasteners 112. In the illustrative embodiment, the mounting bracket 110 may be attached to the end frame 16 using a pair of dowel pins 114 and a single fastener 116. The dowel pins 114 attach to corresponding bores formed in the mounting bracket 110, and extend away from the mounting bracket 110 and the switch 66. Although illustrated as including a pair of dowel pins 114, in some embodiments the mounting bracket 110 may be attached using any number of dowel pins 114 (including a single dowel pin 114). The single fastener 116 passes through an elongated slot 118 formed in the mounting bracket 110, allowing adjustment of the position of the mounting bracket 110 relative to the end frame 16. The single fastener 116 may be embodied as a screw.

Figure 3:
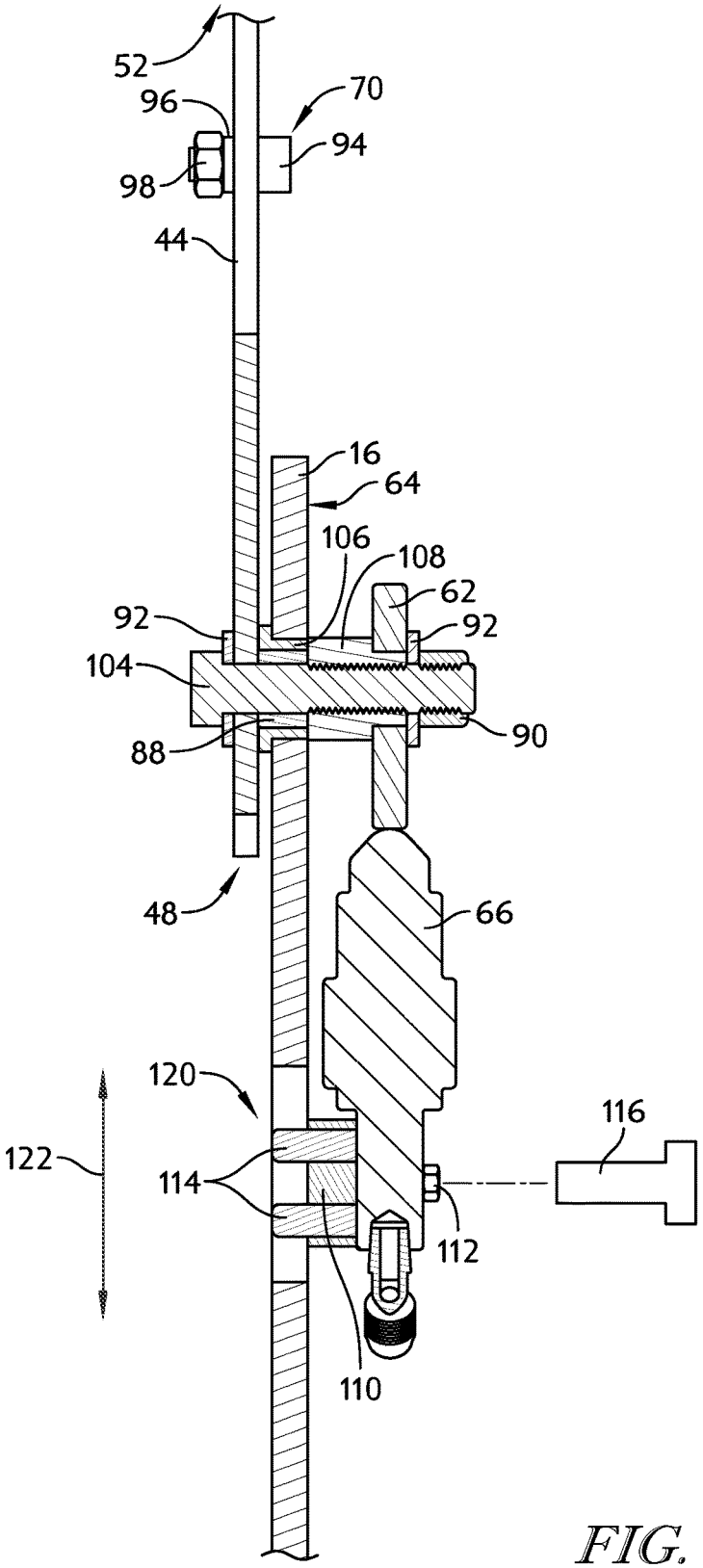
FIG. 3 is a cross-sectional detail view of a portion of the slack line detection system of the winch of FIG. 1.

Referring now to FIG. 3, a cross-sectional detail view of the switch 66 attached the end frame 16 is shown. As can be seen in FIG. 3, the screw 94, the washer 96, and the nut 98 of the drop stop 70 are attached to the lever arm 44. The screw 104 extends through the lever arm 44, the washer 92, the spacer 88, the bearing flange 106, the hex connector 108, the cam 62, the washer 92, and the nut 90.

The switch 66 is attached to the mounting bracket 110 using the fasteners 112. The dowel pins 114 are attached to corresponding bores in the mounting bracket 110. The dowel pins 114 extend away from the mounting bracket 110 into an elongated slot 120 defined in the end frame 16. The elongated slot 120 is sized to allow the mounting bracket 110—and thus the switch 66—to be adjusted up and down, as indicated by the arrows 122. The mounting bracket 110 may be secured to the end frame 16 using the single fastener 116, shown in exploded view for clarity. As described above, the position of the single fastener 116 in the elongated slot 118 defined in the mounting bracket 110 may also be adjusted up and down. Thus, the distance between the cam 62 and the switch 66 may be adjusted by loosening the single fastener 116, moving the mounting bracket 110 up or down, and re-tightening the single fastener 116.

Referring again to FIG. 1, the winch 10 is illustrated in a forward orientation. In the forward orientation, the front ends 50, 52 of the lever arms 42, 44 extend toward the front side 124 of the winch 10 (and away from the back side 126 of the winch 10). As illustrated in FIG. 1, the forward orientation of winch 10 may be used with a vertical takeoff orientation of the slack arm frame 36, that is, with the payout direction 24 generally perpendicular (i.e., at an angle between 80 and 100 degrees) to the surface supporting the winch 10. However, it will be appreciated that the forward orientation of the winch 10 may also be used with a horizontal takeoff orientation of the slack arm frame 36, that is, with the payout direction 24 generally parallel (i.e., at an angle between −10 and 10 degrees) to the surface supporting the winch 10 (see FIG. 4).

Figure 4:
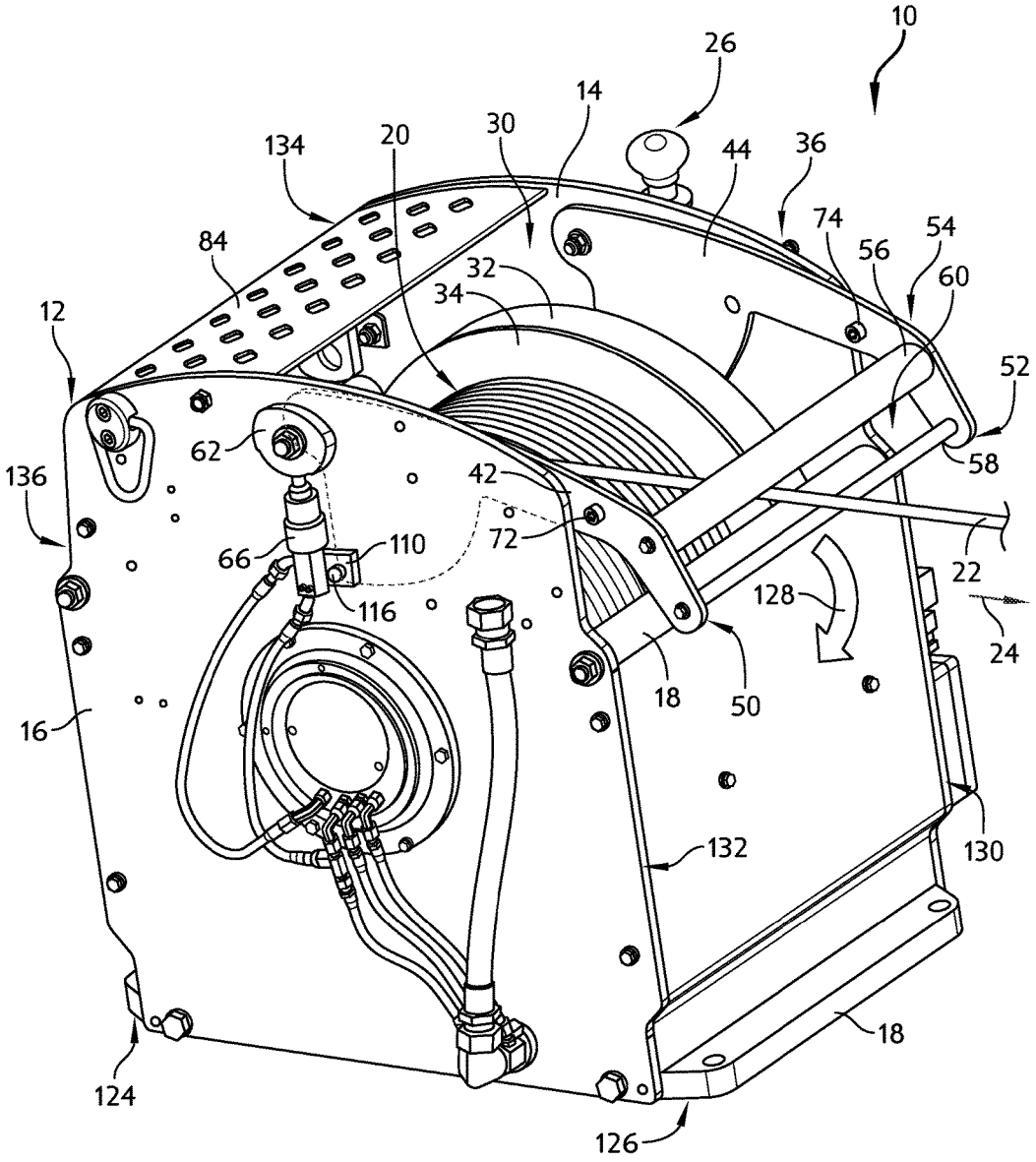
FIG. 4 is a rear perspective view of the winch of FIG. 1, with the slack line detection system installed in a reverse orientation.

Referring now to FIG. 4, the winch 10 is illustrated in a reverse orientation. In the reverse orientation, the front ends 50, 52 of the lever arms 42, 44 extend toward the back side 126 of the winch 10 (and away from the front side 124 of the winch 10). As illustrated in FIG. 4, the reverse orientation of winch 10 may be used with a horizontal takeoff orientation of the slack arm frame 36, that is, with the payout direction 24 generally parallel (i.e., at an angle between −10 and 10 degrees) to the surface supporting the winch 10. However, it will be appreciated that the reverse orientation of the winch 10 may also be used with a vertical takeoff orientation of the slack arm frame 36, that is, with the payout direction 24 generally perpendicular (i.e., at an angle between 80 and 100 degrees) to the surface supporting the winch 10 (see FIG. 1).

The winch 10 may be adjusted to the reverse orientation by installing the slack arm frame 36 and the guard 84 in a reverse orientation. That is, in the reverse orientation, the lever arm 42 may be attached to the end frame 16, and the lever arm 44 may be attached to the end frame 14. Reversing the slack arm frame 36 may be accomplished during installation or while the winch 10 is in service. Additionally, the guard 84 may be removed from its position near the back side 126 (as shown in FIG. 1) and attached near the front side 124 (as shown in FIG. 4). Allowing operation in both forward and reverse orientations increases the flexibility of the winch 10 for use with many different applications.

The operation of the slack arm frame 36 will now be described in detail. When the cable 22 is taut—that is, under tension—the ends 50, 52 of the lever arms 42, 44 are pulled along the payout direction 24 away from the drum 20. The lever arms 42, 44 may extend vertically as shown in FIG. 1 or horizontally as shown in FIG. 4. When the cable 22 is slack—that is, under little or no tension—the ends 50, 52 of the lever arms 42, 44 rotate downward under the force of gravity in a drop direction signified by arrows 128 in FIGS. 1 and 4. The cam 62 rotates with the lever arm 44 (as shown in FIG. 1) or with the lever arm 42 (as shown in FIG. 4) and, thus, rotates as the cable 22 goes from taut to slack. When the cam 62 reaches a preset rotational position corresponding to the cable 22 being slack, the cam 62 activates the switch 66. When activated, the switch 66 sends a pneumatic signal that causes the disc brake and/or the band brake 30 to engage. For example, in the illustrative embodiment, the activated switch 66 may interrupt the flow of compressed air to the air motor system 26, causing the disc brake and/or the band brake 30 to engage. In other embodiments, the switch 66 may cause any other actions appropriate in response to a slack line condition, including signaling alerts or engaging other emergency stop systems.

When the slack arm frame 36 rotates in the drop direction 128, the drop stops 68, 70, 72, 74 also rotate in the drop direction 128 toward the end frames 14, 16. As shown in FIG. 1, when the cable 22 goes slack in the vertical takeoff orientation, the drop stops 68, 70 will engage the end frames 14, 16 to prevent further rotation of the slack arm frame 36. In particular, the screw 94 of the drop stop 68 contacts the top edge 38 of the end frame 14, and the screw 94 of the drop stop 70 contacts the top edge 40 of the end frame 16. The drop stops 68, 70 are positioned to stop the downward rotation of the slack arm frame 36 before the front ends 50, 52 of the lever arms 42, 44 drop between the end frames 14, 16, thus reducing or preventing a potential pinch hazard.

As shown in FIG. 4, when the cable 22 goes slack in the horizontal takeoff orientation, the drop stops 72, 74 will engage the end frames 14, 16 to prevent further rotation of the slack arm frame 36. In particular, the screw 94 of the drop stop 74 contacts a rear edge 130 of the end frame 14, and the screw 94 of the drop stop 72 contacts a rear edge 132 of the end frame 16. The drop stops 72, 74 are positioned to stop the downward rotation of the slack arm frame 36 before the front ends 50, 52 of the lever arms 42, 44 drop between the end frames 14, 16, thus preventing a potential pinch hazard. As shown in FIG. 4, the drop stops 68, 70 are unused in the horizontal takeoff orientation and may be removed from the slack arm frame 36. In some embodiments, the winch 10 may include a single pair of screws 94 and nuts 98 that may be adjusted between the positions of the drop stops 68, 70 for use in the vertical takeoff orientation and the positions of the drop stops 72, 74 for use in the horizontal takeoff orientation.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A winch comprising:

a first end frame and a second end frame;

a drum located between and rotatably coupled to the first and second end frames and configured to rotate to wind or unwind a cable;

a brake configured to resist rotation of the drum when engaged;

a switch coupled to the first end frame configured to cause the brake to engage the drum when the switch is activated;

a slack arm frame having a first end engaged with the cable and a second end pivotally coupled to the first and second end frames, wherein the slack arm frame is pivotable about an axis between a first position when the cable is taut and a second position when the cable is slack, wherein the axis extends through the first and second end frames;

a cam having an arcuate camming surface coupled to the slack arm frame and the first frame end, with the first frame end located between the slack arm frame and the cam, wherein the cam is rotatable with the slack arm frame about the axis to activate the switch when the slack arm frame is in the second position; and a mounting bracket coupling the switch to the first end frame, wherein the mounting bracket is adjustable between a plurality of locations on the first end frame by loosening and tightening a single fastener, each of the plurality of locations positioning the switch at a different distance from the axis.

2. The winch of claim 1, further comprising a motor configured to drive rotation of the drum in response to being supplied with a flow of compressed fluid;

wherein the switch is configured to interrupt the flow of compressed fluid to the motor when the switch is activated.

3. The winch of claim 1, wherein:

the first end frame comprises an elongated slot; and the mounting bracket comprises a dowel pin received in the elongated slot, the dowel pin and the single fastener cooperating to secure the mounting bracket to the first end frame.

4. The winch of claim 1, wherein the slack arm frame is adjustable relative to the cam between (i) a vertical takeoff orientation in which the slack arm frame, when in the first position, extends away from the drum at an angle between 80 and 100degrees to a surface supporting the winch and (ii) a horizontal takeoff orientation in which the slack arm frame, when in the first position, extends away from the drum at an angle between −10and 10 degrees to the surface supporting the winch.

5. The winch of claim 1, wherein the slack arm frame comprises:

a first lever arm pivotally couplable to the first end frame or the second end frame and extending away from the drum toward the first end of the slack arm frame;

a second lever arm pivotally couplable to the second end frame or the first end frame and extending away from the drum toward the first end of the slack arm frame;

a roller assembly coupled between the first and second lever arms at the first end of the slack arm frame, wherein the cable passes through the roller assembly; and a first drop stop coupled to the first lever arm and extending toward the first or second end frame, the first drop stop being configured to engage the first or second end frame when the slack arm frame pivots from the first position to the second position to prevent further pivoting of the slack arm frame.

6. The winch of claim 5, wherein the slack arm frame further comprises a second drop stop coupled to the first or second lever arm and extending toward the second end frame, the first or second drop stop being configured to engage the second end frame when the slack arm frame pivots from the first position to the second position to prevent further pivoting of the slack arm frame.

7. The winch of claim 5, wherein the first drop stop includes a screw coupled to a nut, the screw being configured to engage the first or second end frame when the slack arm frame pivots from the first position to the second position.

8. The winch of claim 5, wherein the slack arm frame is adjustable between:

a forward orientation in which the first lever arm is pivotally coupled to the first end frame, the second lever arm is pivotally coupled to the second end frame, and the first and second lever arms pivot toward a front side of the winch when the slack arm frame pivots from the first position to the second position; and a reverse orientation in which the first lever arm is pivotally coupled to the second end frame, the second lever arm is pivotally coupled to the first end frame, and the first and second lever arms pivot toward a back side of the winch when the slack arm frame pivots from the first position to the second position, the back side of the winch being opposite the front side of the winch.

9. The winch of claim 5, wherein the first lever arm includes a tool hole sized to receive a tool to prevent pivoting of the slack arm frame.

* * * * *